US010987724B2

(12) United States Patent
Matsuo et al.

(10) Patent No.: US 10,987,724 B2
(45) Date of Patent: Apr. 27, 2021

(54) SAND MOLD SHAPING MATERIAL, AND METHOD FOR SHAPING SAND MOLD USING SAME

(71) Applicant: HONDA MOTOR CO., LTD., Tokyo (JP)

(72) Inventors: Nobuki Matsuo, Tochigi-ken (JP); Munemasa Taketani, Tochigi-ken (JP); Koji Shinya, Tochigi-ken (JP); Kojiro Akao, Tochigi-ken (JP); Tsunamasa Shioya, Tochigi-ken (JP)

(73) Assignee: HONDA MOTOR CO., LTD., Tokyo (JP)

( * ) Notice: Subject to any disclaimer, the term of this patent is extended or adjusted under 35 U.S.C. 154(b) by 39 days.

(21) Appl. No.: 16/497,819

(22) PCT Filed: Mar. 30, 2018

(86) PCT No.: PCT/JP2018/013746
§ 371 (c)(1),
(2) Date: Sep. 26, 2019

(87) PCT Pub. No.: WO2018/181943
PCT Pub. Date: Oct. 4, 2018

(65) Prior Publication Data

US 2020/0101523 A1 Apr. 2, 2020

(30) Foreign Application Priority Data

Mar. 31, 2017 (JP) ..... JP2017-071408

(51) Int. Cl.
*B22C 1/18* (2006.01)
*B22C 9/02* (2006.01)

(52) U.S. Cl.
CPC . *B22C 1/18* (2013.01); *B22C 9/02* (2013.01)

(58) Field of Classification Search
CPC ..... B22C 1/18; B22C 9/02
See application file for complete search history.

(56) References Cited

U.S. PATENT DOCUMENTS

| | | | | |
|---|---|---|---|---|
| 2005/0127547 | A1 | 6/2005 | Yamazaki | |
| 2008/0026093 | A1 | 1/2008 | Osaki | |
| 2010/0307714 | A1* | 12/2010 | Yoshida | B22C 9/00 164/527 |

FOREIGN PATENT DOCUMENTS

| | | | | |
|---|---|---|---|---|
| CN | 1638937 | | 7/2005 | |
| DE | 2261426 | A1 * | 6/1974 | B22C 1/22 |
| JP | 50-151722 | | 12/1975 | |
| JP | 51-003316 | | 1/1976 | |

(Continued)

OTHER PUBLICATIONS

EPO machine translation of DE-2261426-A1 (Year: 1974).*

(Continued)

*Primary Examiner* — Kevin E Yoon
(74) *Attorney, Agent, or Firm* — Amin, Turocy & Watson, LLP

(57) ABSTRACT

A sand mold shaping material contains an aggregate comprising inorganic particles, and microcapsules enclosing a binder which causes the aggregate to bind. The binder is a liquid binder that is in a liquid phase at room temperature, and is enclosed in an outer shell comprising a resin that forms the microcapsule. The sand mold shaping material is in a dry state when used to fill a molding die for shaping.

7 Claims, 8 Drawing Sheets

(56) References Cited

FOREIGN PATENT DOCUMENTS

| | | |
|---|---|---|
| JP | 62-238041 | 10/1987 |
| JP | 2006-346747 | 12/2006 |
| JP | 2007-144511 | 6/2007 |

OTHER PUBLICATIONS

Chinese Office Action for Chinese Patent Application No. 201880022643.2 dated Jul. 29, 2020.
International Search Report and Written Opinion for International Application No. PCT/JP2018/013746 dated May 29, 2018, 6 pages.

* cited by examiner

SAND MOLD SHAPING MATERIAL, AND METHOD FOR SHAPING SAND MOLD USING SAME

TECHNICAL FIELD

The present invention relates to a sand mold forming (shaping) material for making a main mold or a sand core (a sand mold) for use in casting, and to a sand mold forming method (method for shaping a sand mold) using the same.

BACKGROUND ART

A sand core for forming a hollow portion in a cast is made out of sand mold forming material (hereinafter sometimes referred to just as "forming material") that contains aggregate formed of inorganic substance particles, and binder. Specifically, the forming material is filled into and molded in a cavity of a molding die and then subjected to an appropriate hardening process. The binder thereby becomes hardened, so that the aggregate binds via the binder. That is, the forming material hardens into a sand core.

A main mold for forming a cavity of a cast is also made by hardening forming material filled in the cavity of a molding die, as with a sand core. Hereinafter, molds that are made out of forming material (sand), such as main molds and sand cores, will be collectively called "sand molds".

One known process for forming sand molds is a cold box process, which commonly uses an organic binder such as phenol resin and causes the binder to harden with amine gas. While the cold box process has the advantage of allowing the binder to harden in a short time without involving heating, it requires an apparatus for treating amine gas without letting it leak to the outside, leading to the problems of large-sized facilities and increased cost.

In the case of using an inorganic binder, such as clay, water glass, and silica sol, as binder, on the other hand, the binder is mixed and kneaded with aggregate to produce forming material in wet state, which is then immediately filled into a molding die. In such a case, however, filling under high pressure is essential in order to provide sufficient flow of the forming material in wet state; thus, forming devices, including the molding die, are required to be pressure-resistant. This results in increased sizes of the forming devices.

In addition, the hardening of the forming material progresses as it dries, which causes clogging during filling or a reduction in filling ratio. Although some measures are available for avoiding it, such as giving moisture to maintain flowability, it is inherently not easy to have sufficient flowability in wet state. Thus, improvement of the filling ratio is not easy.

Furthermore, since the binder becomes dry and hardened over time even in wet state, long-term storage of the binder in the state of forming material is difficult. Due to this property, any forming material remaining in a blow head has to be discarded. That is, this conventional art has the disadvantages of low manufacturing efficiency or material yields and further the necessity of frequent maintenance of the forming devices.

Thus, in some cases, aggregate with its surface coated with an organic binder capable of remelting at high temperatures (for example, resin-coated sand made from aggregate with its surface coated with resin) is employed as the forming material. The forming material can then be in a dry state, so that the ratio of filling into a cavity can be increased compared to when an inorganic binder is used. However, at the same time, it has the problem of producing unpleasant odor when re-heating remelted organic binder, particularly resin, in order to harden it.

Japanese Laid-Open Patent Publication Nos. 2006-346747 and 2007-144511 propose use of microcapsules in which an expanding agent that vaporizes to expand is enclosed in an outer shell made of thermoplastic resin. In such a case, the microcapsules are added to aggregate together with inorganic fiber, organic fiber, and thermosetting resin. Then, slurry made by dispersing these materials in dispersion medium is filled into a cavity and subjected to heat as with the foregoing process.

SUMMARY OF INVENTION

When slurry is used as described in Japanese Laid-Open Patent Publication Nos. 2006-346747 and 2007-144511, high pressure needs to be applied so that the cavity will be filled with the slurry up to its end corners as mentioned above. Besides, reduction in the filling ratio is greater as the cavity has a more complicated shape. Thus, the risk that the resulting sand core has a shape not conforming to the shape of a hollow portion or has insufficient rigidity cannot be eliminated.

A general object of the present invention is to provide a sand mold forming material with a high ratio of filling into a cavity.

A major object of the present invention is to provide a sand mold forming material capable of long-term storage and enabling decrease in the frequency of maintenance of forming devices.

Another object of the present invention is to provide a sand mold forming method using the sand mold forming material.

According to an embodiment of the present invention, provided is a sand mold forming material for making a sand mold, the sand mold forming material containing an aggregate formed of inorganic substance particles, and microcapsules each enclosing a binder that causes the aggregate to bind. The binder is a liquid binder that is in liquid phase at ordinary temperatures. The microcapsules each have an outer shell that encloses the liquid binder and is made of resin. The sand mold forming material is in a dry state when filled into a die for shaping. The "sand mold forming material (forming material)" according to the present invention refers to sand that is used for manufacturing all sorts of sand mold for use in casting.

As indicated above, according to the present invention, the liquid binder is shielded by the outer shell (the liquid binder is encapsulated in the hollow interior of the outer shell). Accordingly, the forming material can be produced by mixing the aggregate and the binder in a state such that the liquid binder is prevented from making direct contact with the atmosphere or the aggregate when the aggregate and the binder are kneaded together to produce the forming material.

That is, since the present sand mold forming material does not dry or harden even when used with an inorganic binder, it eliminates the necessity of giving moisture to the sand mold forming material. In other words, the sand mold forming material can be supplied to a cavity in a dry state. Particles in a dry state have good flowability compared to particles in a wet state. Accordingly, the present sand mold forming material provides a high ratio of filling into a cavity.

Besides, since the present sand mold forming material is prevented from hardening at ordinary temperatures as mentioned above, it enables long-term storage in a state in which the aggregate and the microcapsules are mixed, namely in the state of sand mold forming material. For a similar reason, there is no particular necessity to remove any sand mold forming material remaining in a gate or the like of a forming device. Accordingly, the frequency of maintenance of the forming device can be reduced.

If the particle diameter of the microcapsules is excessively small, the microcapsules tend to agglomerate together due to static electricity. It would then not be easy to mix the microcapsules and the aggregate uniformly. Thus, the microcapsules each preferably have a particle diameter of 5 μm or greater. This can avoid the agglomeration of the microcapsules regardless of the type of resin that forms the outer shell. Thus, the microcapsules can be dispersed uniformly in the aggregate, enabling reliable formation.

Further, the outer shell of each of the microcapsules is preferably made of resin having a melting point equal to or lower than a hardening starting temperature of the liquid binder, because it can reliably avoid a situation where the liquid binder hardens in the outer shell before the outer shell melts and the aggregate cannot bind.

According to another embodiment of the present invention, provided is a sand mold forming method for making a sand mold by shaping a sand mold forming material, the sand mold forming method including extruding the sand mold forming material placed in a blow head from the blow head with blowing fluid at a pressure of 0.15 to 0.5 MPa, and moving the sand mold forming material to a cavity formed in a molding die. The sand mold forming material contains an aggregate formed of inorganic substance particles, and microcapsules each having an outer shell made of resin and a liquid binder enclosed in the outer shell, the liquid binder being in liquid phase at ordinary temperatures and causing the aggregate to bind.

As mentioned above, the sand mold forming material according to the present invention is in a dry state and has high flowability. Thus, it easily flows into a cavity even with the blowing fluid being set at a low pressure of 0.15 to 0.5 MPa. Accordingly, a line, a blow head, and the like for supplying the blowing fluid are not specifically required to be pressure-resistant, and correspondingly facility investment can be reduced.

Since the present invention uses microcapsules having liquid binder encapsulated in the outer shell, the sand mold forming material can be produced in a state such that the liquid binder is prevented from making direct contact with the atmosphere or the aggregate. The sand mold forming material thus does not dry or harden, so that the sand mold forming material can be supplied to a cavity in a dry state without being given moisture. Thus, the ratio of filling into the cavity can be high. This enables making of a sand mold (such as a main mold and a sand core) of desired shape.

Besides, since the sand mold forming material does not dry or harden at ordinary temperatures, the sand mold forming material can be preserved for a long time period in the state of sand mold forming material, and can be left remaining in a gate and the like of a forming device. Accordingly, the frequency of maintenance of the forming device can be reduced.

DESCRIPTION OF EMBODIMENTS

A sand mold forming method according to the present invention is described in detail below in connection with a sand mold forming material used for this method by showing preferred embodiments and with reference to the accompanying drawings.

Figure 1:
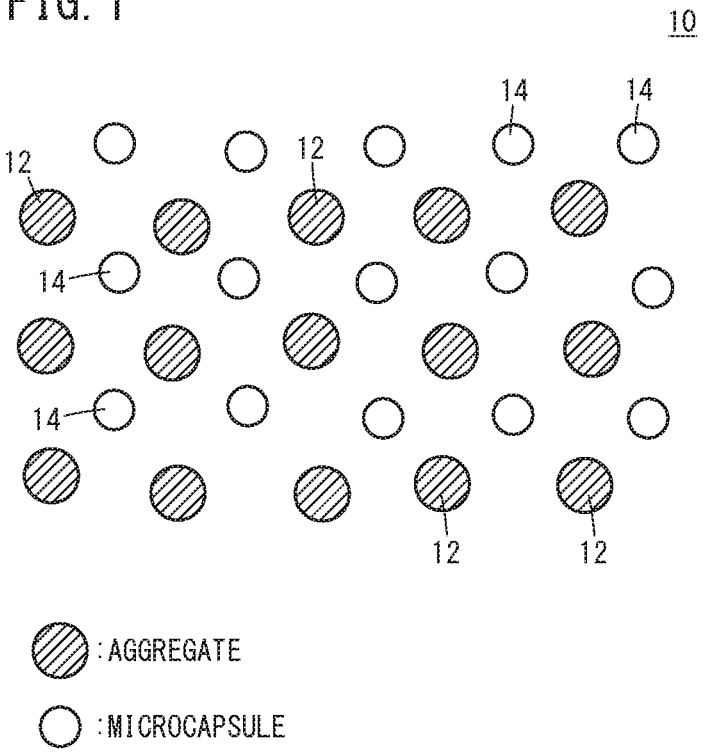
FIG. 1 schematically shows component particles contained in a sand mold forming material according to an embodiment of the present invention.

First, the sand mold forming material (forming material) according to an embodiment is described with reference to FIG. 1, which schematically shows component particles of the forming material. A forming material 10 according to the present invention contains an aggregate 12 and microcapsules 14.

The aggregate 12 is formed of particles of an inorganic substance. The inorganic substance may be any known inorganic substance used as the aggregate 12 of the forming material 10 for making a main mold or a sand core. Suitable examples thereof include metallic oxides such as $ZrO_2$, $SiO_2$, and $Al_2O_3$. A mixture of them may be used, of course. $SiO_2$ may be natural silica sand.

Figure 2:
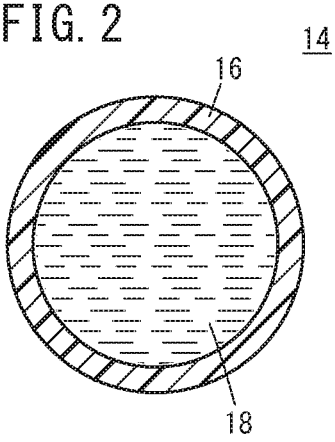
FIG. 2 is a schematic cross-sectional view of the microcapsule shown in FIG. 1.

The microcapsules 14 each have an outer shell 16 as shown in FIG. 2, which shows a schematic cross section thereof. In this embodiment, the outer shell 16 is made of resin. A predetermined amount of liquid binder 18 is encapsulated in a hollow interior of the outer shell 16. In other words, the outer shell 16 encloses the liquid binder 18.

The liquid binder 18 is in liquid phase at ordinary temperatures and gradually exhibits binding capacity as it hardens when given heat. That is, it serves as binder by hardening. For the liquid binder 18 of this type, an inorganic binder such as clay, water glass, and silica sol, or an organic binder such as resin may be chosen as appropriate as with the aforementioned conventional arts.

The outer shell 16 is substantially sphere shaped and shields the liquid binder 18. In other words, the liquid binder 18 is separated from the atmosphere and from the aggregate 12 by the outer shell 16. This keeps the liquid binder 18 from hardening in the hollow interior of the outer shell 16.

If the resin that forms the outer shell 16 has an excessively high melting point, it is conceivable that the liquid binder 18, in particular an inorganic binder with a low hardening temperature, starts to harden in the hollow interior before the outer shell 16 melts. For avoiding it, the outer shell 16 is preferably made of resin having a melting point equal to or lower than the hardening starting temperature of the liquid binder 18.

Figure 3:
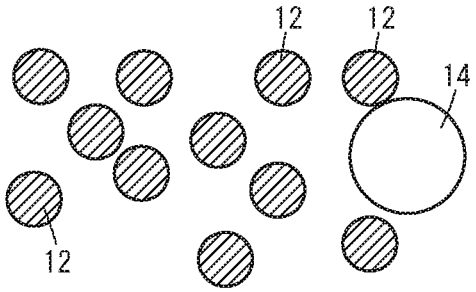
FIG. 3 schematically shows a case where an average particle diameter of aggregate is smaller than the average particle diameter of the microcapsules.

Preferably, an average particle diameter of the aggregate 12 and that of the microcapsules 14 have a small difference from each other. This is because it enables the microcapsules 14 to disperse in the aggregate 12 substantially uniformly. If the average particle diameter of the microcapsules 14 is too large relative to the aggregate 12, it would not be easy for the microcapsules 14 to be present between the particles of the aggregate 12 as shown in FIG. 3.

Figure 4:
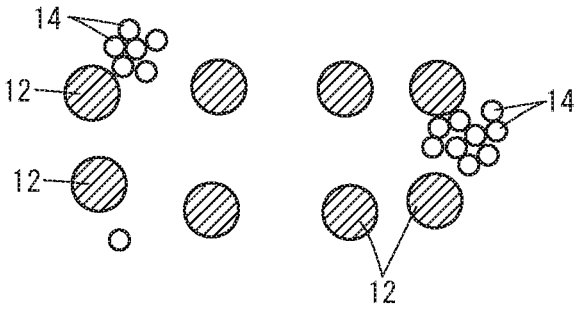
FIG. 4 schematically shows a case where the average particle diameter of the aggregate is larger than the average particle diameter of the microcapsules.

Also, the particle diameter of the microcapsules 14 is preferably 5 μm or greater. If the particle diameter is less than 5 μm, the microcapsules 14 would be smaller in diameter than the aggregate 12 as shown in FIG. 4. Then, the microcapsules 14 would agglomerate due to static electricity and become unevenly distributed, making it difficult to disperse the microcapsules 14 in the aggregate 12.

Next, the action and effects of the forming material 10 structured as described above are described in connection with the sand mold forming method according to this embodiment.

Figure 5:
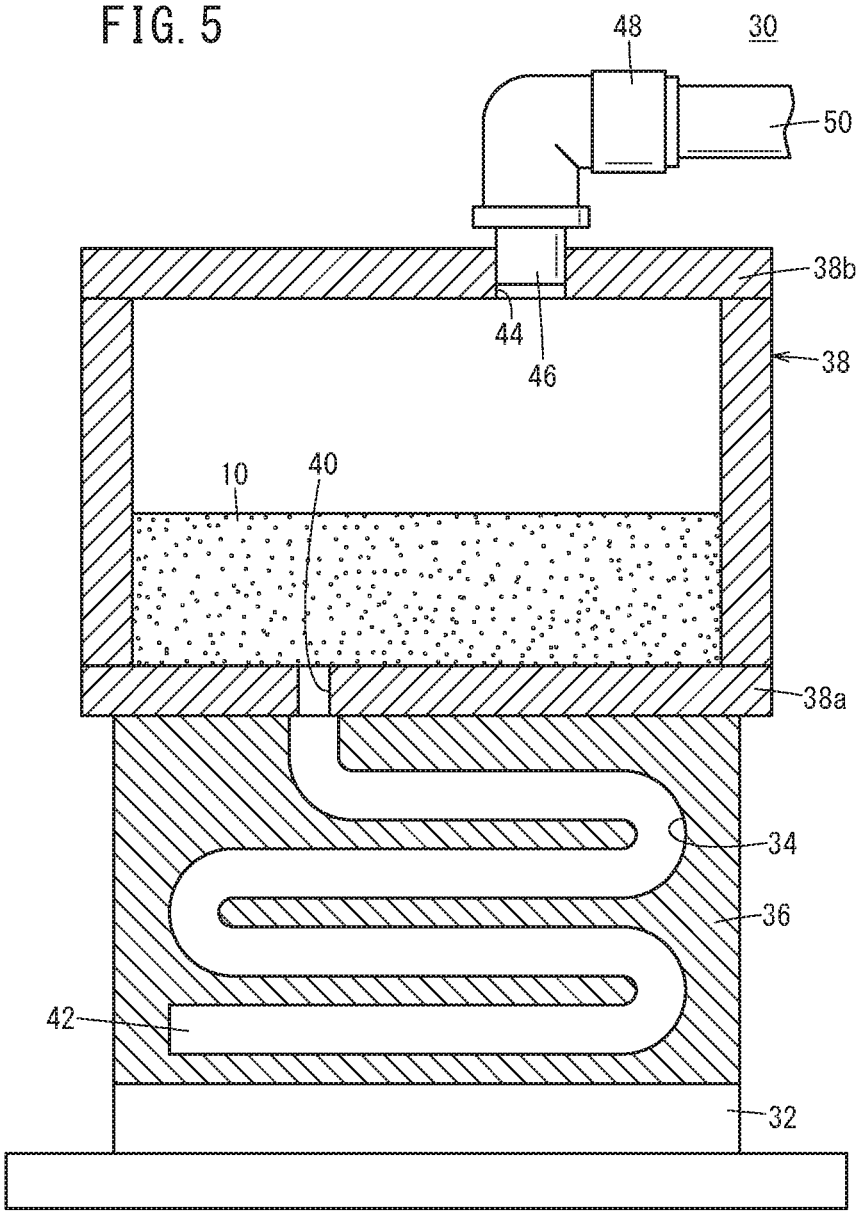
FIG. 5 is a schematic vertical cross-sectional view of relevant portions of a test forming device for determining the filling ratio of a sand mold forming material.

FIG. 5 is a schematic vertical cross-sectional view of relevant portions of a test forming device 30 for performing the forming method. The test forming device 30 is roughly described below.

The test forming device 30 includes a die base 32, a die 36 (molding die) having a cavity 34, and a blow head 38. The die 36 is removable from the die base 32 and the blow head 38 is removable from the die 36. A sand mold can be taken out of the die 36 after the die 36 is removed from the die base 32 and the blow head 38 is removed from the die 36.

In this example, the cavity 34 has a serpentine (meandering) shape and is formed as a one-way passage with the upper portion thereof facing the side of the blow head 38 being the upstream side and the lower portion thereof facing the die base 32 being the downstream side. In short, an inlet port on the side of a gate 40 is the furthest upstream and a dead end portion 42 closed at the tip is the furthest downstream.

It is very difficult for the forming material 10 to flow through the cavity 34 having such a shape. That is, compared to a cavity of a forming device for making a sand mold used for formation of a hollow portion in a cast, the cavity 34 has a shape that makes it difficult to be filled with the forming material 10.

In a bottom wall 38*a* of the blow head 38, the gate 40 in communication with the cavity 34 is formed. The forming material 10 flows into the cavity 34 through the gate 40. A blowing port 44 is formed in a ceiling wall 38*b* of the blow head 38, and a blowing nozzle 46 is connected to the blowing port 44. The blowing nozzle 46 is connected to a compressed air (blowing fluid) source, not illustrated, via a pipe fitting 48 and a feed hose 50.

The forming method according to this embodiment is now described by illustrating a case where the forming method is performed using the test forming device 30 structured as described above. The following shows an example where water glass, which is an inorganic binder, is used as the liquid binder.

To start with, the forming material 10 containing the aggregate 12 and the microcapsules 14 is placed in the blow head 38. It is not necessary to give moisture to the forming material 10 in the blow head 38. This is because, since water glass (the liquid binder 18) is enclosed in the outer shell 16 of the microcapsule 14 as mentioned above, contact of the water glass with the atmosphere or the aggregate 12 avoided, and hence the hardening of the water glass is avoided.

In this way, this embodiment allows the forming material 10 to exhibit flowability even without being given moisture for preventing the hardening of the water glass. This facilitates handling of the forming material 10.

Next, the blow head 38 is set on top of the die 36 attached to the die base 32. The die 36 has been preheated to about 150° C.

Then, compressed air is supplied into the blow head 38 from the compressed air source via the feed hose 50 and the blowing nozzle 46. By being pressed from above by the compressed air, the forming material 10 on the side of the bottom wall 38*a* starts to flow into the cavity 34 from the gate 40. Here, since the forming material 10 has sufficient flowability, the compressed air may be set at a low pressure. Specifically, a pressure of 0.15 to 0.5 MPa is sufficient. Thus, the feed hose 50, the blowing nozzle 46, the pipe fitting 48, and the like can be formed from general-purpose components for low pressure. Thus, facility investment can be reduced.

After flowing from the gate 40, the forming material 10 flows along the cavity 34 to reach the dead end portion 42. The blowing is stopped when a predetermined amount of time has passed, thereby stopping the flowing of the forming material 10 into the cavity 34.

The forming material 10 is further left to stand for a predetermined amount of time. Because the die 36 has been heated as mentioned above, heat is given to the forming material 10 while the forming material is left to stand. This causes the outer shell 16 of the microcapsule 14 to melt, resulting in an outflow of the water glass encapsulated in the hollow interior of the outer shell 16. When the melting point of the resin that forms the outer shell 16 is equal to or lower than the hardening starting temperature of the water glass, hardening of the water glass in the outer shell 16 prior to melting of the outer shell 16 can be advantageously avoided.

The water glass hardens by being given heat with the hardening starting temperature or higher. The inorganic substance particles as the aggregate 12 thereby bind together, leading to formation of a sand mold such as a main mold and a sand core.

In this process, occurrence of unpleasant odor, such as that occurring when resin-coated sand is used, is avoided. This is presumably due to the fact that water glass, which is an inorganic binder, is used and that the amount of resin that forms the outer shell 16 of the microcapsule 14 is significantly smaller than the amount of resin in resin-coated sand.

In addition, the water glass is shielded by the outer shell 16 of the microcapsule 14 in the forming material 10 as mentioned above. Since the outer shell 16 does not melt at ordinary temperatures, the water glass is prevented from drying and hardening after wetting the aggregate 12. That is, hardening of the forming material 10 at ordinary temperatures is avoided.

Accordingly, if the forming material 10 remains in the blow head 38, for example, it can be preserved for a long time period as it is. Further, hardening of the forming material 10 attached to the gate 40 or the like is avoided; thus, there is no particular necessity to remove it. Thus, the frequency of maintenance of the test forming device 30 can be reduced.

Figure 6:
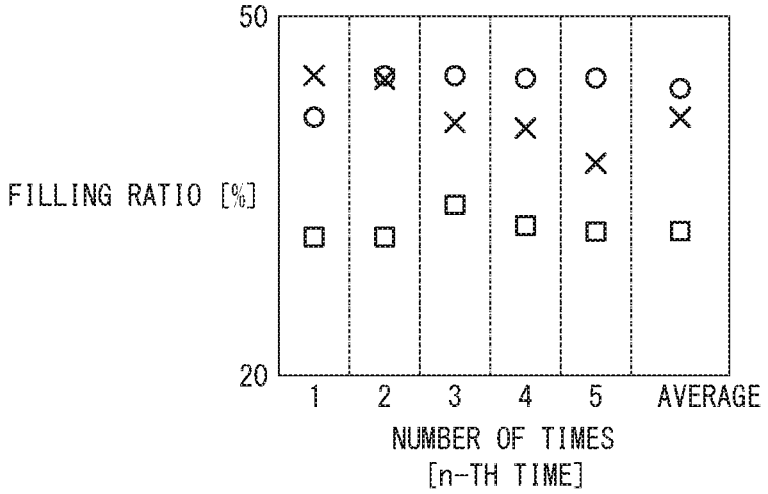
FIG. 6 is a graph showing filling ratios when the pressure of compressed air as blowing fluid is 0.15 MPa.
Figure 7:
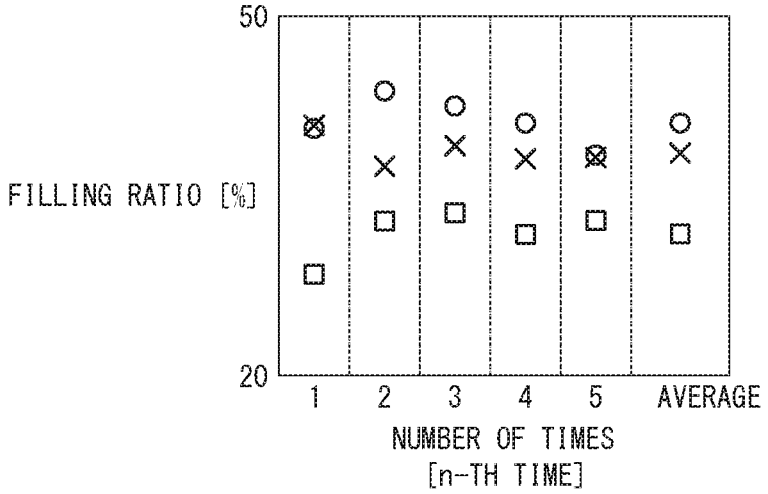
FIG. 7 is a graph showing filling ratios when the pressure of compressed air is 0.3 MPa.
Figure 8:
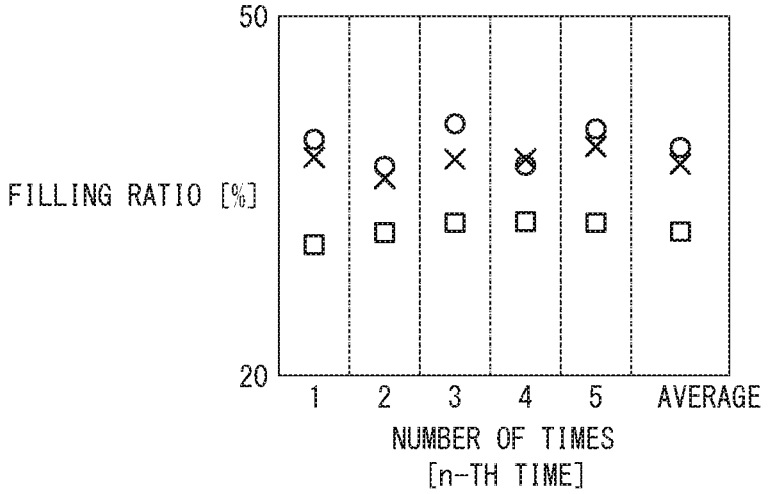
FIG. 8 is a graph showing filling ratios when the pressure of compressed air is 0.5 MPa.

FIGS. 6 to 8 show graphs indicating the results of filling ratios when the cavity 34 of the test forming device 30 is filled multiple times using the forming material 10, resin-coated sand as an organic binder, and a forming material of a conventional art containing the aggregate 12 added with an inorganic binder. FIGS. 6 to 8 show the filling ratios with compressed air of 0.15 MPa, 0.3 MPa, and 0.5 MPa, respectively, and with a blowing duration of 5 seconds and heat application for 60 seconds, where the plots indicated by ○, x, and □ represent the forming material 10, the resin-coated sand, and the forming material of the conventional art, respectively. Only for the resin-coated sand, the temperature of the die 36 was set at 250° C., which is the hardening starting temperature of the resin.

Further, the filling ratio was calculated according to Formula (1):

$$P=\{W/(V\times\rho)\}\times 100 \quad (1)$$

where P is the filling ratio (%), W is the weight of the forming material 10 used for filling (g), V is the volume of the cavity 34 ($cm^3$), and ρ is the density of the forming material 10 ($g/cm^3$).

With reference to FIGS. 6 to 8, it can be seen that the filling ratio of the forming material 10 has the greatest mean value at all pressures. Further, from the fact that high filling ratios are achieved with the forming material 10 despite the cavity 34 having a shape that makes it difficult to be filled and a relatively short duration of 5 seconds, the filling ratio is estimated to be about 95% to 98% with a typical molding die that can be easily filled.

The present invention is not particularly limited to the foregoing embodiment and various modifications are possible without departing from the scope of the present invention.

For example, in the above embodiment, the resin that forms the outer shell 16 of the microcapsule 14 is melted with heat, whereby the liquid binder 18 enclosed in the outer shell is applied to the aggregate 12. However, the outer shell 16 may also be semipermeable membrane such that, after the mold is filled with the forming material 10, high humidity air is circulated through the cavity 34 to make moisture permeate into the microcapsule 14 and increase its internal pressure, thereby breaking the outer shell 16 to apply the liquid binder 18 to the aggregate 12.

Alternatively, the cavity 34 after being filled may be mechanically pressurized to rupture the outer shell 16 of the microcapsule 14, thereby applying the liquid binder 18 to the aggregate 12.

In these cases, the start timing of hardening of the forming material 10 can be more accurately controlled compared to a method that melts the outer shell 16 of the microcapsule 14 by heating. Besides, the time for sufficiently cooling the die before being filled with the forming material 10 can be shortened, whereby more efficient forming is possible.

The heating method can be any way of heating using an existing heater, oven, microwave, or the like as a heating unit, and is not particularly limited.

REFERENCE SIGNS LIST

10 sand mold forming material
12 aggregate
14 microcapsule
16 outer shell
18 liquid binder
30 test forming device
34 cavity
36 die
38 blow head
40 gate
46 blowing nozzle
50 feed hose

What is claim is:

1. A sand mold forming material for making a sand mold,
the sand mold forming material comprising an aggregate formed of inorganic substance particles, and microcapsules each enclosing a binder that causes the aggregate to bind, wherein
the binder is a liquid binder that is in liquid phase at ordinary temperatures,
the microcapsules each have an outer shell that encloses the liquid binder and is made of resin having a melting point equal to or lower than a hardening starting temperature of the liquid binder, and
the sand mold forming material is in a dry state when filled into a die for shaping.

2. The sand mold forming material according to claim 1, wherein the microcapsules each have a particle diameter of 5 μm or greater.

3. The sand mold forming material according to claim 1, wherein the liquid binder is made of an inorganic substance.

4. A sand mold forming method for making a sand mold by shaping a sand mold forming material,
the sand mold forming method comprising extruding the sand mold forming material placed in a blow head from the blow head with blowing fluid at a pressure of 0.15 to 0.5 MPa, and moving the sand mold forming material to a cavity formed in a molding die,
the sand mold forming material containing an aggregate formed of inorganic substance particles, and microcapsules each having an outer shell and a liquid binder enclosed in the outer shell, the liquid binder being in liquid phase at ordinary temperatures and causing the aggregate to bind, the outer shell being made of resin having a melting point equal to or lower than a hardening starting temperature of the liquid binder.

5. The sand mold forming method according to claim 4, wherein the sand mold forming material is extruded from the blow head without being given moisture.

6. The sand mold forming method according to claim 4, wherein the molding die is heated to melt the outer shell, and the liquid binder is caused to flow out of the microcapsules.

7. The sand mold forming method according to claim 4, wherein a residue of the sand mold forming material remaining in the blow head is stored in the blow head until next formation.

* * * * *